US005738541A

United States Patent [19]

Tseng

[11] Patent Number: 5,738,541

[45] Date of Patent: Apr. 14, 1998

[54] ASSEMBLING MECHANISM OF CONNECTOR HAVING BOARDLOCK AND SPACER

[75] Inventor: Green Tseng, Taipei Hsien, Taiwan

[73] Assignee: Hon Hai Precision Ind. Co., Ltd., Taiwan

[21] Appl. No.: 629,553

[22] Filed: Apr. 9, 1996

[51] Int. Cl.[6] ..... H01R 13/66

[52] U.S. Cl. ..... 439/567; 439/607

[58] Field of Search ..... 439/567, 554–7, 439/571, 607

[56] References Cited

U.S. PATENT DOCUMENTS 5,147,220 9/1992 Lybrand ..... 439/567
5,407,364 4/1995 Tzeng et al. ..... 439/567

*Primary Examiner*—Khiem Nguyen
*Assistant Examiner*—Eugene G. Byrd

[57] ABSTRACT

An I/O connector (10) includes an insulative housing (12) having a plurality of passageways (14) extending therethrough for receiving a corresponding number of contacts (16) therein. A metal shell (18) is attached to the front mating surface (22) of the housing (12). A spacer (24) is attached to the housing (12) from the back wherein the spacer (24) includes a pair of engagement blocks (36) outwardly extending at two longitudinally opposite ends and pressed by the vertical plates (62) of the corresponding rivets (60), respectively. Therefore, the tails of the contacts (16) can be precisely aligned with regard to the circuits on the PC board. A pair of boardlocks (40) each without its own retention plate in alignment with the corresponding rivet (60), while includes an extended tag (46) extending through a through-slot (54) in the housing (12) for having its distal end contact the shell (18) to constitute a grounding path.

11 Claims, 5 Drawing Sheets

ASSEMBLING MECHANISM OF CONNECTOR HAVING BOARDLOCK AND SPACER

BACKGROUND OF THE INVENTION

1. Field of the Invention

The invention relates to I/O (Input/Output) connectors, and particularly to mechanism of the connector having boardlocks for mounting on the mother board and the spacer for alignment of the contact tails with circuits on the mother board.

2. The Prior Art

The general I/O connector includes an insulative housing having a plurality of passageways for receiving a corresponding number of contacts therein. To align the contact tails with regard to the corresponding circuits on the PC board on which the connector is mounted, a spacer is optimally attached to the rear portion of the housing. In addition, a pair of boardlocks are fastened to the opposite ends of the housing for engagement within a pair of corresponding apertures in the board for maintaining the connector on the board.

FIGS. 1(A) and 1(B) shows a conventional I/O connector 101 having an insulative housing 102 with a plurality of passageways 103 for receiving a corresponding number of contacts 104 therein, respectively wherein a spacer 105 with a pair of hooks 106 on two ends for engagement with the protrusions 107 on the housing 102 for retaining the spacer 015 onto the housing 102. Also, a pair of boardlocks 108 are fastened to two opposite ends of the housing 102 for engagement with the holding apertures in the PC board (not shown) on which the connector 101 is mounted.

Because the size of the connector gets tinier and tinier, it becomes more difficult to precisely make the small dimensioned hooks 106 and the protrusions 107 for mating with each other. Understandably, if the relative dimensions between the hooks 106 and the protrusions 107 is too loose, the spacer 105 can not be retained with regard to the housing 102; oppositely, if the relative dimensions therebetween is too tight, the spacer 105 can not be smoothly attached onto the housing 102. Therefore, a different retention method between the spacer 105 and the housing 102 is desired to substitute the aforementioned conventional one.

Another issue is related to the boardlocks 108. The reasons why most I/O connectors 101 have the boardlock 108 comprising a retention plate 111 into which the rivet 109 extends, includes:

(1) retaining the boardlocks 108 to the housing 102; and (2) establishing a grounding path from the shell 110 of the connector 101 through the rivet 109, the retention plate 11 of the boardlock 108 and the mounting legs 112 of the boardlock 108, finally to the PC board on which the connector 101 is mounted.

There are so many U.S. Patents relating to the boardlock. For example, for the past year, such boardlock devices can be referred to U.S. Pat. Nos. 5,393,247, 5,401,187, 5,401,188, 5,460,543, 5,468,154, 5,468,160, 5,478,257 and 5,489,219 wherein most of them are used with non-I/O connectors each of which substantially has no external shell thereon for grounding consideration, and therefore, such type boardlock without the retention plate to cooperation with the rivet, is only required to have means for retaining itself onto the housing.

An object of the invention is to provide mechanism of an I/O connector having a tiny spacer adapted to be retained to the housing easily and reliably wherein, to comply with the interlocking structures of the spacer and the housing, the boardlocks by two sides of the spacer are simplified to include no retention plate but still maintaining the grounding effect as before.

SUMMARY OF THE INVENTION

According to an aspect of the invention, an I/O connector includes an insulative housing having a plurality of passageways extending therethrough for receiving a corresponding number of contacts therein. A metal shell is attached to the front mating surface of the housing. A spacer is attached to the housing from the back wherein the spacer includes a pair of engagement blocks outwardly extending at two longitudinally opposite ends and pressed by the expansion plates of the rivets. Therefore, the tails of the contacts can be precisely aligned with regard to the circuits on the PC board. A pair of boardlocks each with no retention plate in alignment with the corresponding rivet, includes an extended strap extending through a through-slot in the housing for having its distal end contact the shell to constitute a grounding path.

BRIEF DESCRIPTION OF THE DRAWINGS

FIG. 2(A) is an enlarged perspective view of the boardlock of FIG. 2.

FIG. 2(B) is an enlarged fragmentary perspective view of the housing of FIG. 2 to show the corresponding structures for receiving the boardlock therein.

FIG. 2(C) is an enlarged cross-sectional view of the housing of FIG. 2 to show the corresponding structures for receiving the boardlock therein.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 2:
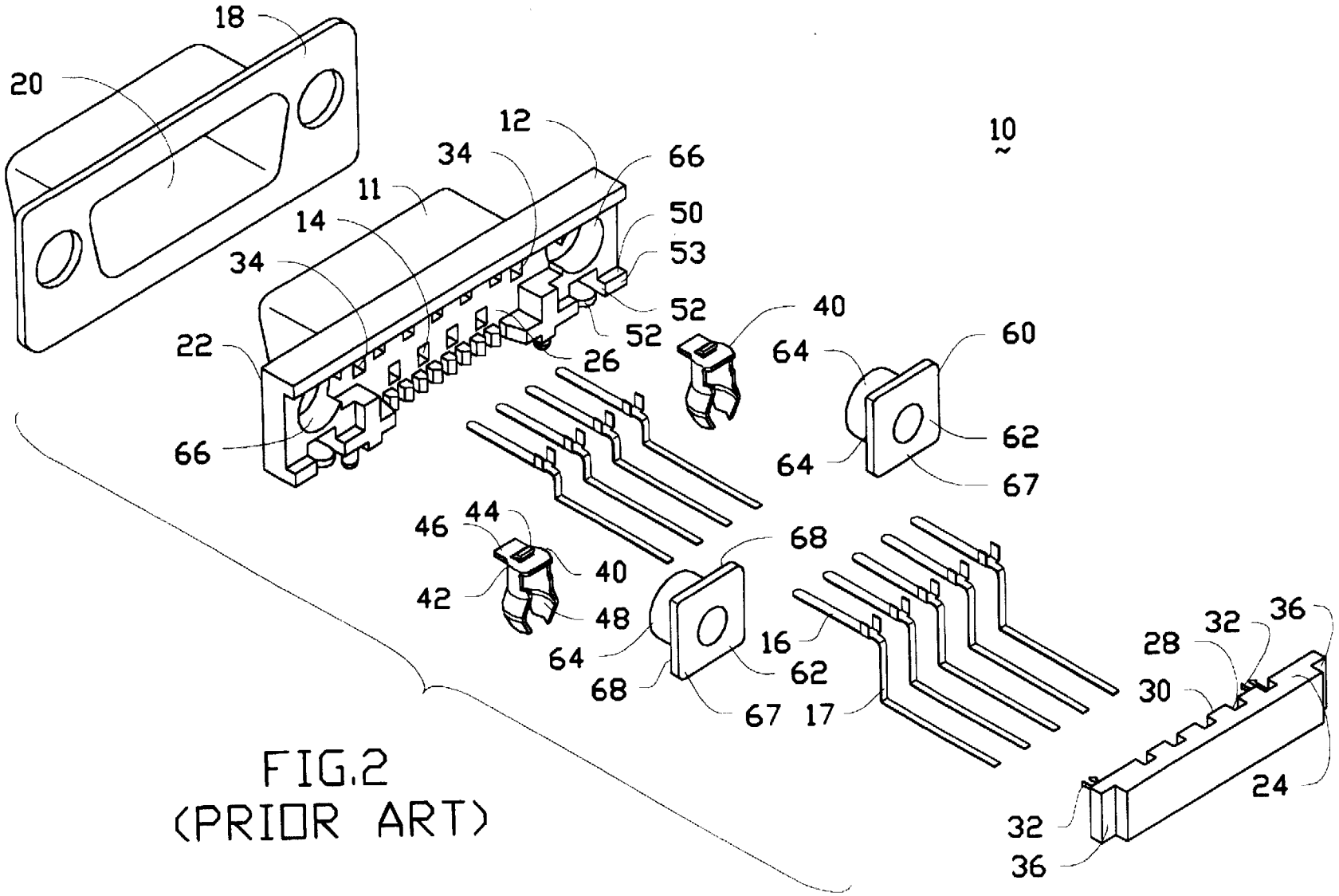
FIG.2 (PRIOR ART)
FIG. 2 is an exploded perspective view of a presently preferred embodiment of an I/O connector according to the invention wherein the carrier of the contacts has not been cut and removed therefrom.
Figure 2:
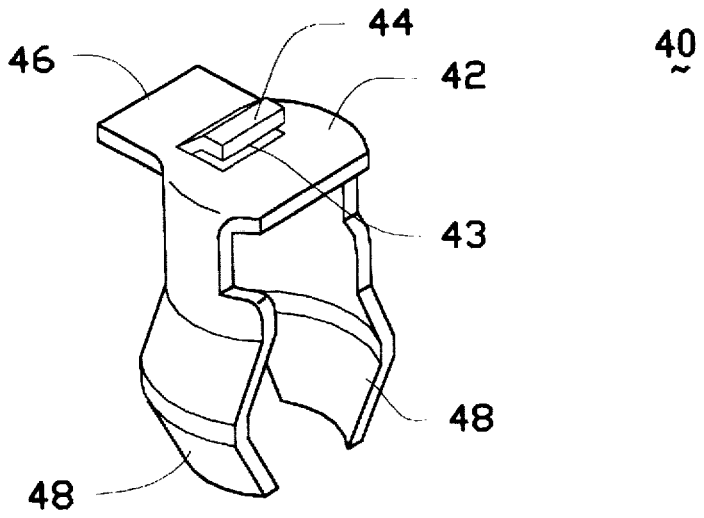
Figure 2:
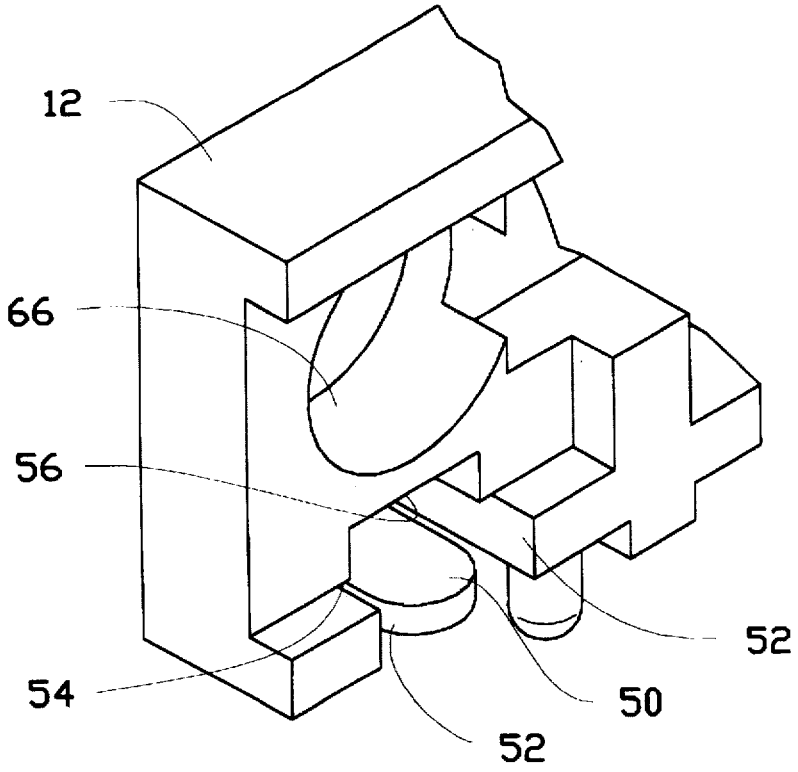
Figure 2:
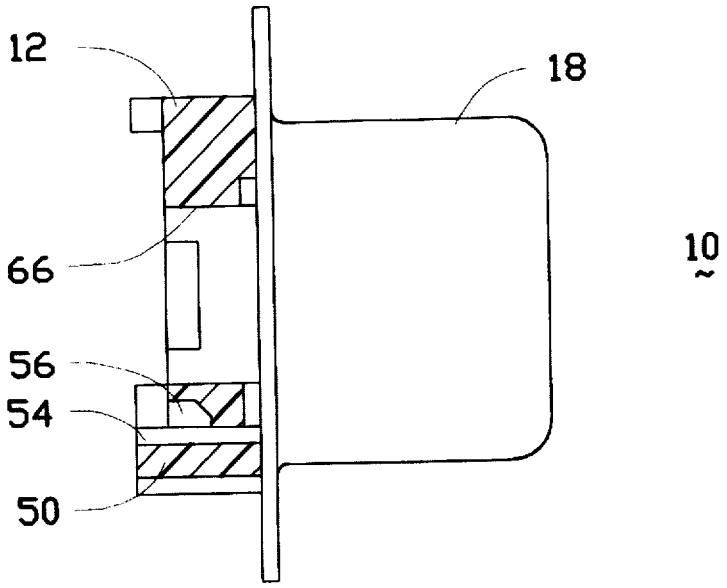
Figure 3:
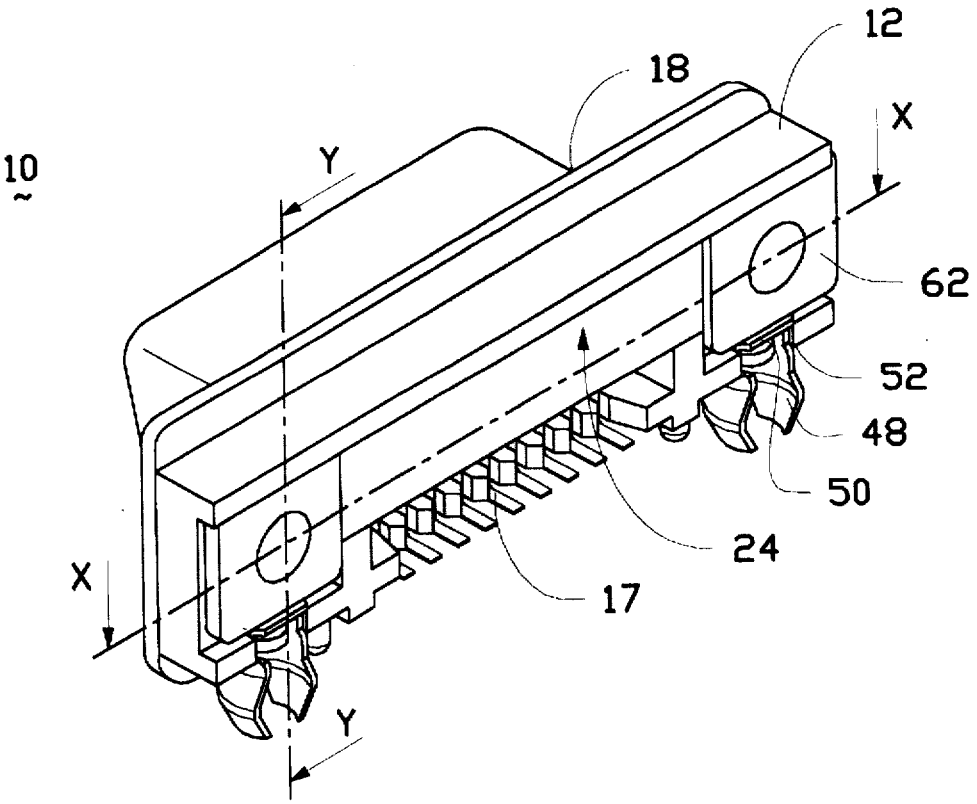
FIG. 3 is a perspective view of the assembled connector of FIG. 2.

It will be noted here that for a better understanding, most of like components are designated by like reference numerals throughout the various figures in the embodiments. Attention is directed to FIGS. 2 and 3 wherein an I/O connector 10 includes an insulative housing 12 with a plurality of passageways 14 extending through in a front-to-end direction for receiving a corresponding number of contacts 16 therein.

A metal shell 18 defining a receiving cavity 20, is attached to the mating front surface 22 of the housing 12 wherein the cavity 20 receives the island-shaped section 11 of the housing 12 therein. A spacer 24 is attached to the rear surface 26 of the housing 12 wherein the spacer 24 includes a plurality of channels 28 extending vertical along the inner (front) surface 30 for holding the contact tails 17 therein for alignment consideration. To fasten the spacer 24 to the housing 12, a pair of posts (i.e., the first retention device) 32 integrally extending forward from the front surface 30 for interferential engagement within a corresponding pair of holes 34 in the housing 12. The spacer 24 can further include a pair of retention blocks (i.e., the second retention device) 36 outwardly extending from two opposite lengthwise ends thereof which can cooperate with a pair of corresponding rivets 60 that will be illustrated in detail later.

A pair of boardlocks 40 is positioned at two opposite ends of the housing 12. Also referring to FIG. 2(A), boardlock 40 includes a base 42 having an upward extending tang 44, a forwardly and horizontally extending tag 46, and a pair of downward extending mounting legs 48 on two sides. Also referring to FIGS. 2(B) and 2(C), correspondingly, the housing 12 includes a pair of platforms 50 on two opposite ends. To receive such pair of mounting legs 48, a pair of first slots 52 extend forward and inward from the back surface 53 of the platform 50. Differently, to completely receive the base 42 and the extended tag 46, a second slot 54 is formed generally above the first slots 52 while substantially extends through the whole thickness of the housing 12. Additionally, a third slot 56 is formed above and in alignment with the second slot 54. Therefore, as shown in FIG. 5, when the boardlock 40 is positioned on the housing 12, the base 42 is substantially fully seated on the platform 50 wherein the mounting legs 48 extend downward through the first slots 52, respectively, the tag 46 is received within the second slot 54 until its distal end abuts against the shell 18, and the tang 44 is received within the third slot 56.

Figure 4:
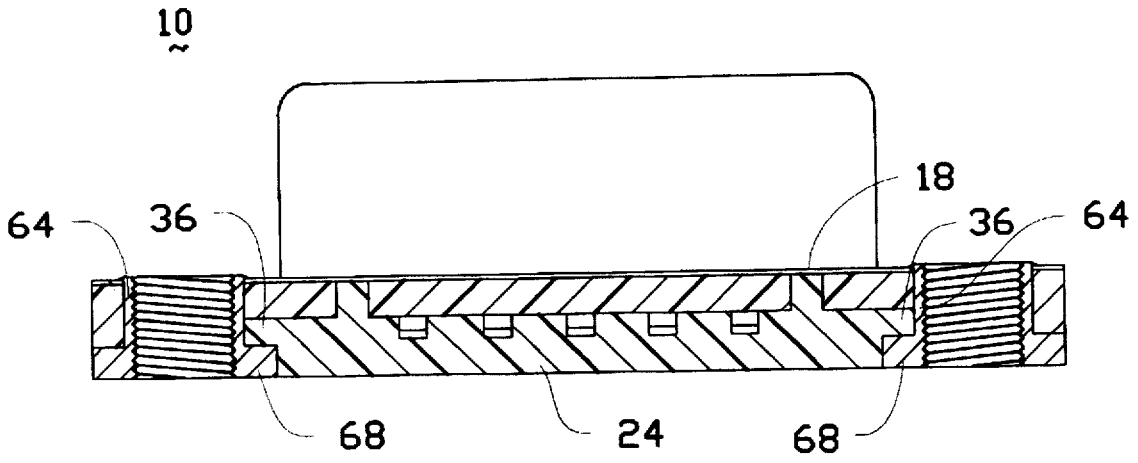
FIG. 4 is a cross-sectional view, taken along line X—X, of the assembled connector of FIG. 3 to show the interlocking engagement among the housing, the spacer and the rivet.
Figure 5:
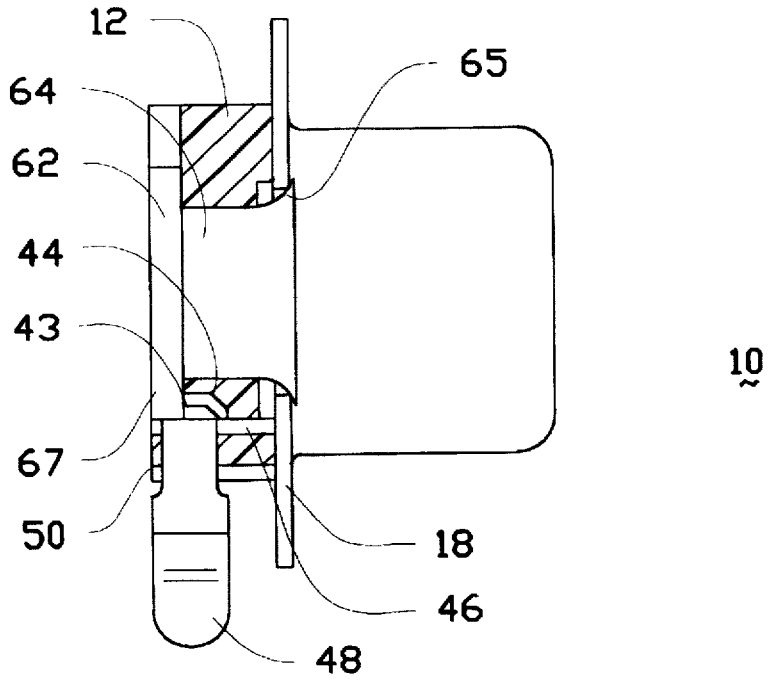
FIG. 5 is another cross-sectional view, taken along line Y—Y, of the assembled connector of FIG. 3 to show the interlocking conductive engagement among the shell, the boardlock, the rivet in the housing.

Then, a pair of rivets 60 are attached to the back portion of housing 12 above the corresponding platforms 50 wherein each rivet 60 includes a vertical plate 62 and a cylindrical section 64, whereby the cylindrical section 64 extends through the screw hole 66 in the housing 12 with the tip 65 rearward folded for fastening the rivet 60 to the housing 12 (FIG. 5). Under this situation, the bottom portion 67 of the vertical plate 62 of the rivet 60 abuts against the tip 43 of the tang 44 to lock the boardlock 40 in position in the housing 12 (FIG. 5), and inner side portion 68 of the vertical plate 62 simultaneously presses against the block 36 of the spacer 24 to provide additional retention of the spacer 24 to the housing 12 (FIG. 4).

Figure 1:
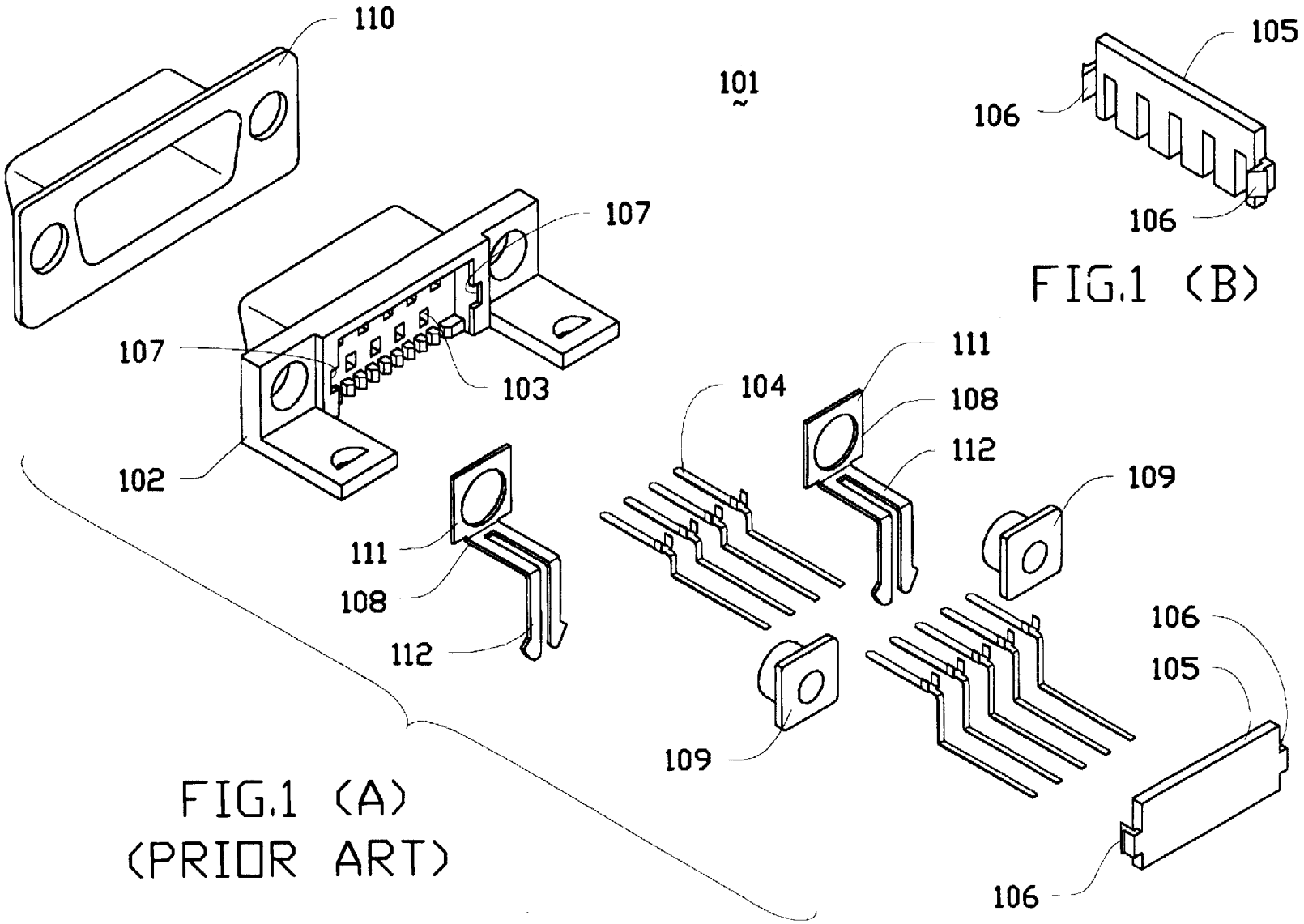
FIG.1 (A) (PRIOR ART)
FIG. 1(A) is an exploded perspective view of a conventional I/O connector wherein the carrier of the contacts has not been cut and removed therefrom.
FIG. 1(B) is an enlarged perspective view of the spacer of FIG. 1(A).

It can be seen that the spacer 24 in the invention is easy to fabricate and also easy to be assembled to the housing 12 in comparison with the prior art connector as shown in FIG. 1. Also, because the platform 50 includes a pair of first slots 52 designedly extending forward from the rear surface 53 of the platform 50, the boardlock 40 can be easily assembled to the platform 50 of the housing 12 from the back in a condition that the mounting legs 48 move within and along the first slots 52 horizontally. This forward movement allows the tag 46 of the boardlock 40 to be horizontally inserted into and move along the second slot 54 until the tip of the tag 46 of the boardlock 40 confronts the shell 18. Moreover, the boardlock 40 in the invention which intentionally removes the conventional retention plate thereof (i.e., numeral 111 in FIG. 1) for not interfering with the outwardly, protruding block 36, is securely retained within the housing 12 in the front-to-end direction by confrontation with the shell 18 on the front portion and with the vertical plate 62 of the rivet 60 on the rear portion, and also in the vertical direction by restraint in the second and third slots 54, 56. It is appreciated that a grounding path can be established from the shell 18, through the boardlock 40, to the PC board (not shown) on which the connector is mounted.

In conclusion, the present invention provides an I/O connector having simple components adapted to be easily assembled while still keeps good grounding effect and reliable interlocking. While the present invention has been described with reference to specific embodiments, the description is illustrative of the invent and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. A connector comprising:

an insulative housing having a plurality of passageways extending therethrough in a front-to-end direction for receiving a corresponding number of contacts therein;

a spacer having a pair of blocks positionable at two opposite ends thereof;

a boardlock positioned on either end of the housing; and a rivet positioned at either end of the housing with a vertical plate thereof;

wherein at least one block of the spacer is substantially sandwiched between one rivet and the corresponding end of the housing.

2. The connector as described in claim 1, wherein said spacer further comprises a pair of posts for interferential engagement within a pair of corresponding holes in the housing.

3. The connector as described in claim 1, wherein said boardlock includes a base, an upward extending tang, a forward extending tag, and at least a downward extending mounting leg.

4. The connector as described in claim 3, wherein said tag confronts a shell positioned on a front mating surface of the housing, and said tang confronts the vertical plate of the rivet.

5. The connector as described in claim 3, wherein said housing includes at two ends a pair of platforms on which the boardlocks are seated, and whereby the base of the boardlock is substantially and fully seated on the corresponding platform; and the housing further includes a first slot, a second slot and a third slot for respectively receiving the mounting leg, the tag and the tang of the boardlock therein.

6. A connector comprising:

an insulative housing with a plurality of contacts therein; and at least a boardlock positioned on a platform of the housing, said platform located between a pair of first slots which are formed in either end of the housing;

said boardlock including a base adapted to be substantially fully seated on the platform with a pair of opposite mounting legs extending through said pair of first slots and said platform being arranged between the pair of mounting legs whereby the boardlock can be assembled to the platform from the back of the housing.

7. The connector as described in claim 6, wherein said boardlock is interlocked within the housing in a front-to-end direction by a shell on a front portion and a rivet on a rear portion.

8. The connector as described in claim 6, wherein said boardlock further includes a forward extending tag and an upward extending tang, and the housing includes a second slot and a third slot for receiving said tang and said tag, correspondingly.

9. A boardlock for use with a connector having an insulation housing, comprising:

a base;

a tang upward extending from the base to be received within said housing and having further a tip rearward extending therefrom;

a tag forward extending from the base to be received within said housing; and a pair of mounting legs downward extending from two opposed sides of the base, respectively.

10. A connector comprising:

an insulative housing at least having a first slot and a second slot therein each extending in a horizontal direction wherein the second slot is substantially formed above and is interconnected with the first slot;

at least a boardlock having a base, and a tag extending from the base and at least a mounting leg downward extending from the base;

wherein said mounting leg further extends through the first slot and said tag is received in the second slot whereby the boardlock can be assembled to the housing.

11. A connector comprising:

an insulative housing having a plurality of passageways extending therethrough in a front-to-end direction for receiving a corresponding number of contacts therein;

a spacer having a pair of blocks positionable at two opposite ends thereof;

a boardlock positioned on a platform at either end of the housing; and a rivet positioned at either end of the housing with a vertical plate thereof;

wherein said boardlock is substantially separated from said spacer by the rivet in a same vertical plane with regard to the housing for avoiding an interference with the block of said spacer.

* * * * *